US005205011A

United States Patent [19]

Flener

[11] Patent Number: 5,205,011

[45] Date of Patent: Apr. 27, 1993

[54] HAIR BRUSH CLEANING APPARATUS

[76] Inventor: Richard S. Flener, 811 E. Main, Wilburton, Okla. 74578

[21] Appl. No.: 835,313

[22] Filed: Feb. 14, 1992

[51] Int. Cl.[5] ..... A46B 13/04

[52] U.S. Cl. ..... 15/142; 15/38; 15/104.8; 15/104.92

[58] Field of Search ..... 15/38, 39, 104.5, 104.8, 15/104.92, 142

[56] References Cited

U.S. PATENT DOCUMENTS

| | | | |
|---|---|---|---|
| 883,752 | 4/1908 | Spicer | 15/142 |
| 1,152,168 | 8/1915 | Gast | 15/142 |
| 1,546,548 | 7/1925 | MacCune | 15/142 X |
| 3,080,591 | 3/1963 | Townsend | 15/39 X |
| 3,147,501 | 9/1964 | Schulz et al. | 15/38 |
| 3,348,253 | 10/1967 | McCoy | 15/38 |
| 4,403,364 | 9/1983 | Schroeder | 15/38 X |

*Primary Examiner*—Chris K. Moore
*Attorney, Agent, or Firm*—Leon Gilden

[57] ABSTRACT

A housing is arranged with a plurality of adjacent plates pivotally mounted below a top wall of the housing, wherein the plates include inter-digitated finger members that are aligned in a first coplanar relationship relative to one another to receive a hair brush, whereupon projection of the hair brush between the plates effects engagement of the plates with the associated hair brush bristles to effect cleaning of the bristles upon projection of the fingers within the hair brush.

7 Claims, 7 Drawing Sheets

HAIR BRUSH CLEANING APPARATUS

BACKGROUND OF THE INVENTION

1. Field of the Invention

The field of invention relates to hair brush cleaning apparatus, and more particularly pertains to a new and improved hair brush cleaning apparatus wherein the same is arranged for the removal of hair and debris from within a hair brush matrix of bristles.

2. Description of the Prior Art

Various hair brushing cleaning apparatus has been utilized in the prior art and exemplified in the U.S. Pat. No. 4,403,364 to Schroeder; U.S. Pat. No. 3,470,575 to Larson, et al.; and U.S. Pat. No. 3,590,413 to Couleon, Jr.

The prior art has set forth various elaborate constructions utilizing machinery to effect cleaning of hair brush bristles, where the instant invention sets forth a new and improved hair brush cleaning apparatus wherein the same is arranged to effect the mechanical cleaning of hair brush bristles and in this respect, the present invention substantially fulfills this need providing for a simplified inter-digited plurality of plates cooperating to remove hair from within a matrix of hair brush bristles.

SUMMARY OF THE INVENTION

In view of the foregoing disadvantages inherent in the known types of hair brush cleaning apparatus now present in the prior art, the present invention provides a hair brush cleaning apparatus wherein the same is arranged to provide a housing to receive a hair brush therewithin to effect removal of hair from the hair brush bristles upon removal of the hair brush subsequent to its projection within the housing of the organization. As such, the general purpose of the present invention, which will be described subsequently in greater detail, is to provide a new and improved hair brush cleaning apparatus which has all the advantages of the prior art hair brush cleaning apparatus and none of the disadvantages.

To attain this, the present invention provides a housing arranged with a plurality of adjacent plates pivotally mounted below a top wall of the housing, wherein the plates include inter-digited finger members that are aligned in a first coplanar relationship relative to one another to receive a hair brush, whereupon projection of the hair brush between the plates effects engagement of the plates with the associated hair brush bristles to effect cleaning of the bristles upon projection of the fingers within the hair brush.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair brush cleaning apparatus which has all the advantages of the prior art hair brush cleaning apparatus and none of the disadvantages.

It is another object of the present invention to provide a new and improved hair brush cleaning apparatus which may be easily and efficiently manufactured and marketed.

It is a further object of the present invention to provide a new and improved hair brush cleaning apparatus which is of a durable and reliable construction.

An even further object of the present invention is to provide a new and improved hair brush cleaning apparatus which is susceptible of a low cost of manufacture with regard to both materials and labor, and which accordingly is then susceptible of low prices of sale to the consuming public, thereby making such hair brush cleaning apparatus economically available to the buying public.

Still yet another object of the present invention is to provide a new and improved hair brush cleaning apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
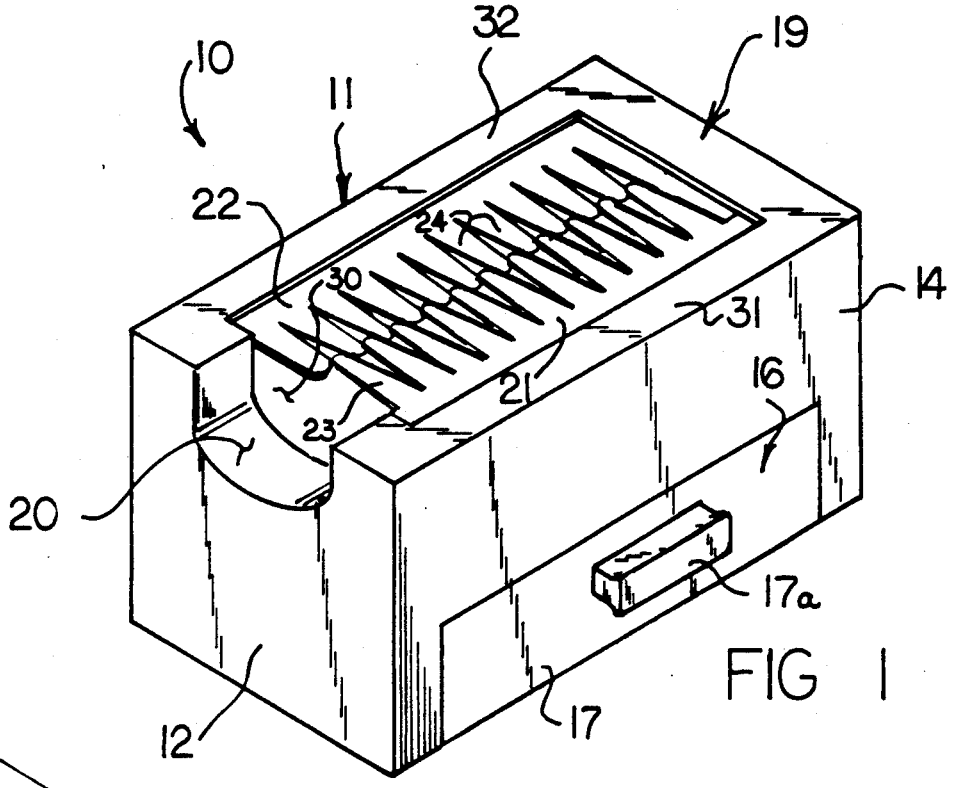
FIG. 1 is an isometric illustration of the instant invention.

With reference now to the drawings, and in particular to FIGS. 1 to 13 thereof, a new and improved hair brush cleaning apparatus embodying the principles and concepts of the present invention and generally designated by the reference numerals 10 and 10*a* will be described.

Figure 2:
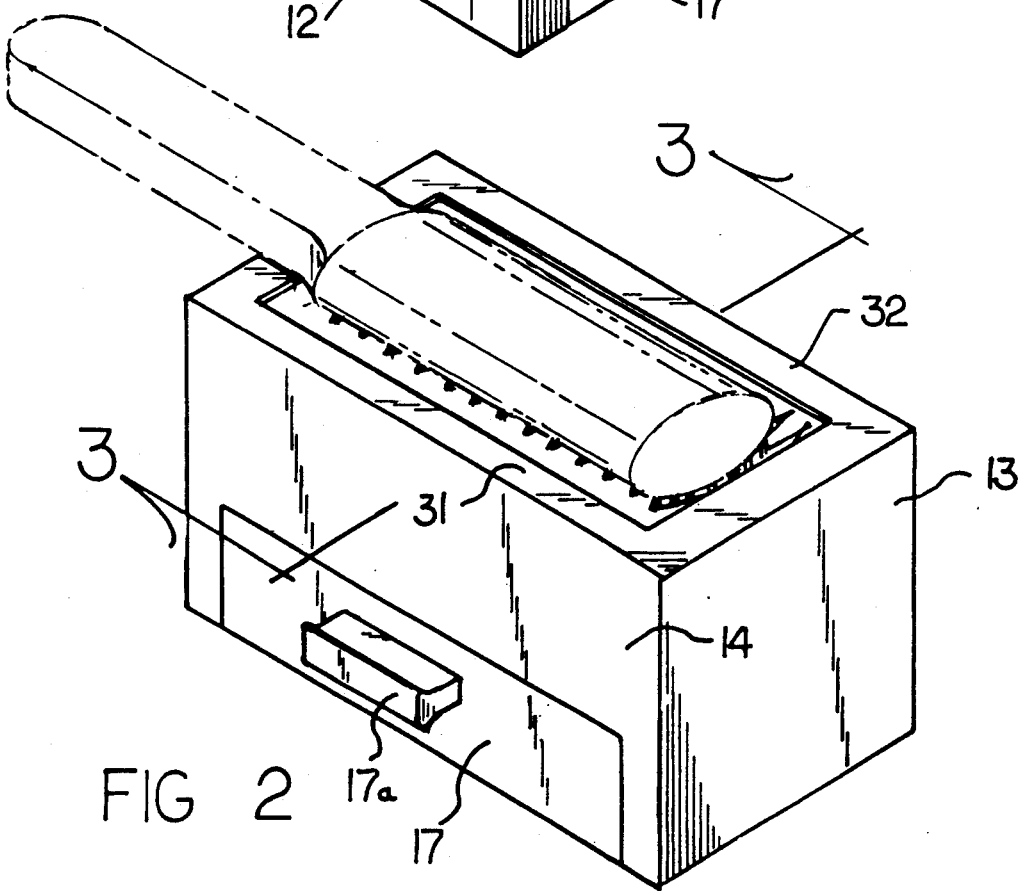
FIG. 2 is an isometric illustration of the instant invention illustrating a hair brush member directed therewithin.
Figure 3:
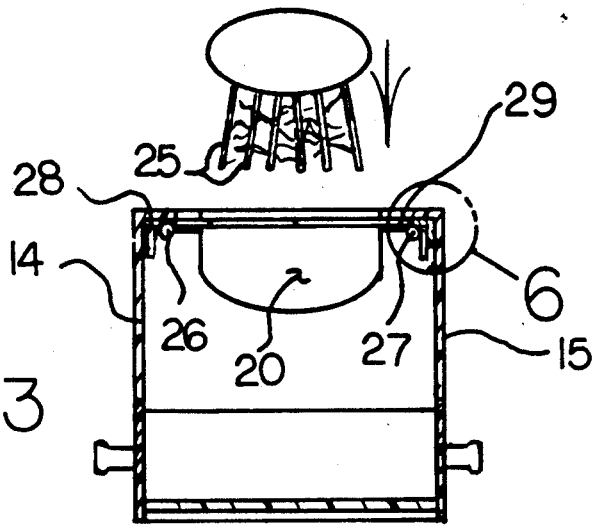
FIG. 3 is an orthographic cross-sectional illustration of the invention with the hair brush in a first position above the housing of the invention.
Figure 6:
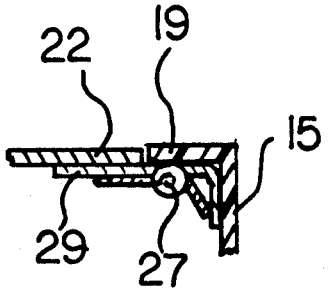
FIG. 6 is an orthographic cross-sectional illustration of section 6 as set forth in FIG. 3.
Figure 4:
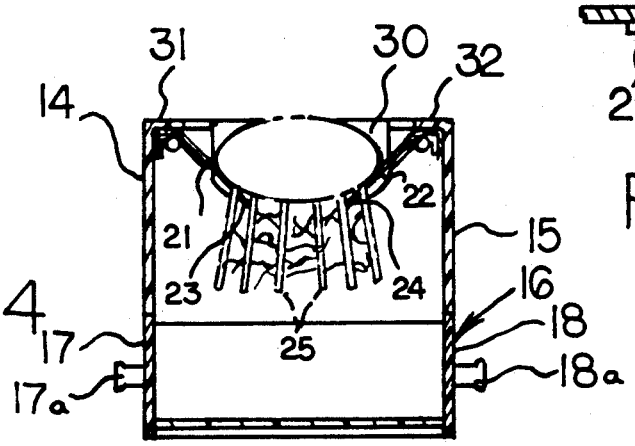
FIG. 4 is an orthographic cross-sectional illustration of the hair brush in a second position directed between the plates.

More specifically, the hair brush cleaning apparatus 10 of the instant invention essentially comprises a housing 11 that includes a housing rear end wall 12 spaced from a housing front end wall 13. Housing first and second side walls 14 and 15 respectively have slidingly directed therethrough a tray member 16, with the tray member 16 including a first and second respective tray wall 17 and 18 that are each respectively coplanar with the respective first and second side walls 14 and 15 when positioned within the housing. A first and second handle 17*a* and 18*a* mounted to the respective first and second tray walls 17 and 18 permit sliding projection of the tray from the housing to permit cleaning of the tray subsequent to use of the organization. A housing top wall 19 includes spaced coplanar top wall first and second side flanges 31 and 32 defining a top wall opening 30 therebetween. The top wall opening 30 merges with a rear end wall recess 20 to receive the handle portion of an associated brush member, such as illustrated in FIG. 2, with the head, and more specifically the matrix of brush bristles 25, directed into the top wall opening 30. The organization further includes first and second plates 21 and 22 respectively mounted within the housing at an intersection of the respective first and second side walls 14 and 15 and the respective top wall first and second side flanges 31 and 32. A first and second pivot hinge 26 and 27 are thusly mounted adjacent an upper terminal end of the first and second side walls 14 and 15 at interior surfaces thereof, each mounted to a respective first and second plate support flange 28 and 29 mounted to the respective first and second pivot hinge 26 and 27 below the top wall first and second side flanges 31 and 32.

Figure 5:
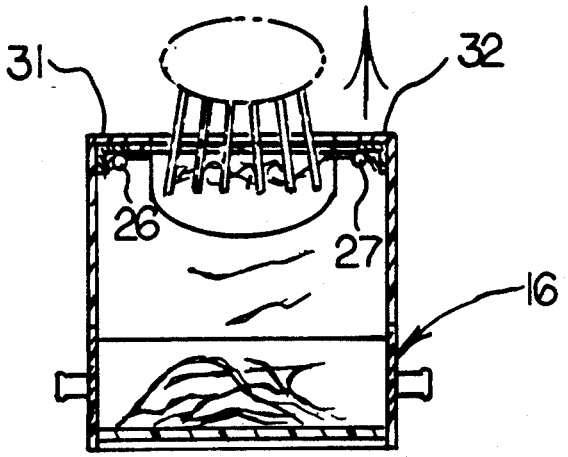
FIG. 5 is an orthographic cross-sectional illustration of the invention illustrating the hair brush removed from between a place to effect removal of undesirable hair from between the bristle matrix of the hair brush.

The first and second plates 21 and 22 include respective first and second plate teeth 23 and 24 that are interdigited in the first coplanar relationship between the first and second plate 21 and 22 and are displaced for projection between the brush bristles 25. Upon removal of the brush, as illustrated in FIG. 5, from between the plates, hair is thusly prevented from escape from between the plates 21 and 22 and deposited into the underlying tray 16 below.

Figure 7:
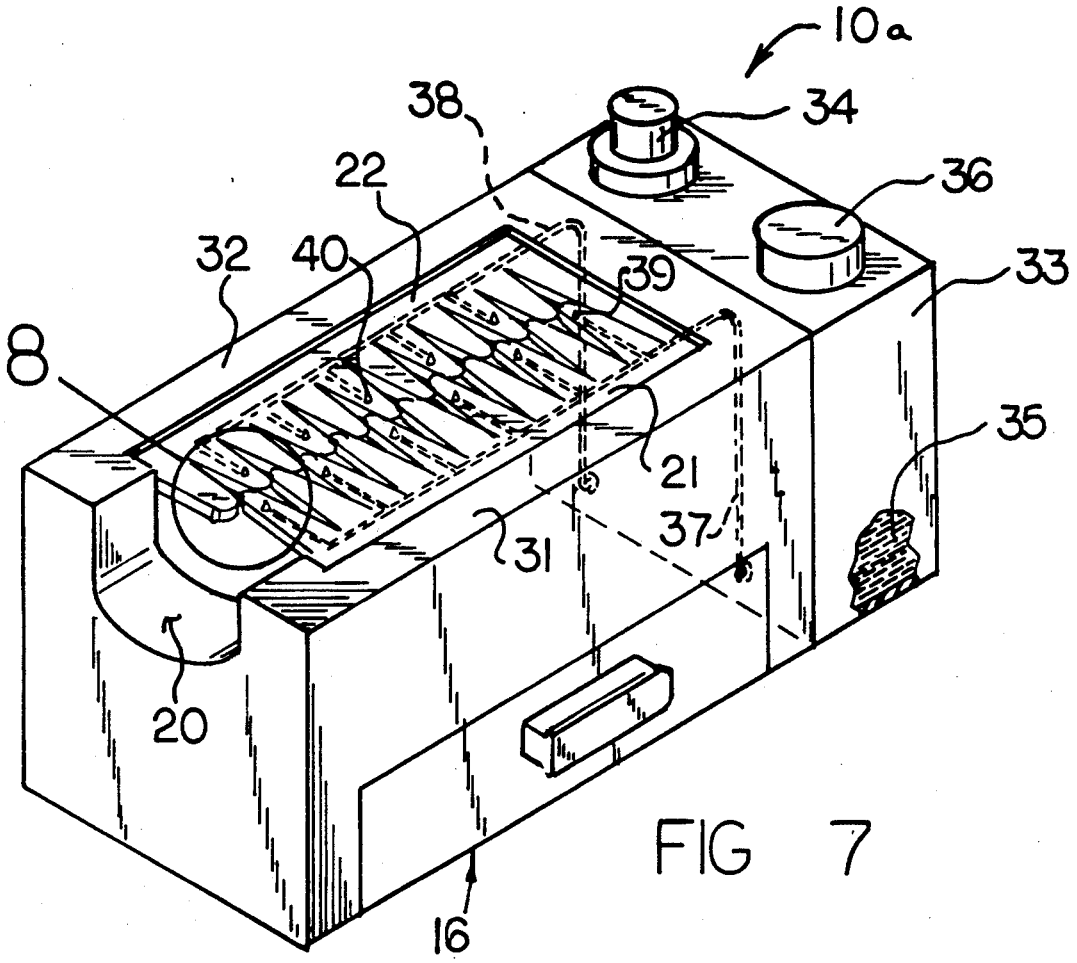
FIG. 7 is an isometric illustration of a modified apparatus utilized by the invention.
Figure 8:
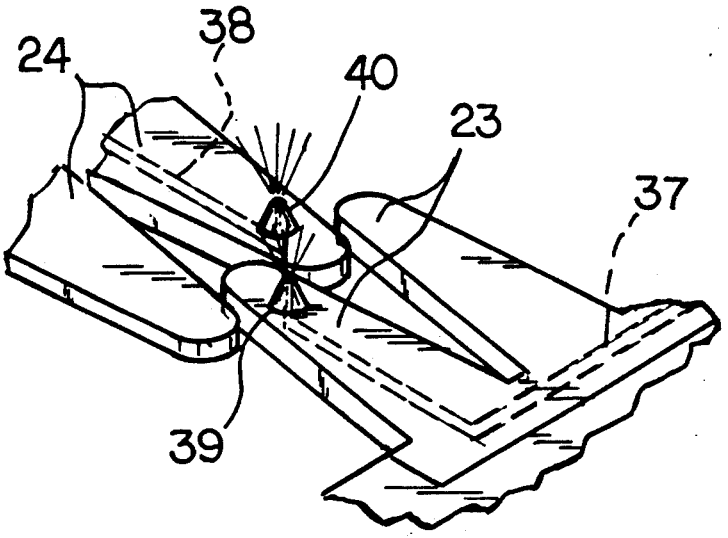
FIG. 8 is an isometric illustration of section 8 as set forth in FIG. 7.

The apparatus 10*a*, as illustrated in FIGS. 7 and 8 for example, further utilize a reservoir 33 mounted to the front end wall 13, including a reservoir fill cap 36 to permit filling of the reservoir with a disinfectant fluid 35 that is projected from the reservoir by a pump plunger 34. First and second flexible conduits 37 and 38 upon pressurizing of the reservoir by the plunger 34 effects projection of fluid within the first and second conduits 37 and 38, wherein the first and second conduits 37 and 38 terminate in respective first and second nozzles 39 and 40 directed upwardly relative to the first and second plate teeth 23 and 24 for projection onto the associated brush head for its disinfecting.

Figure 9:
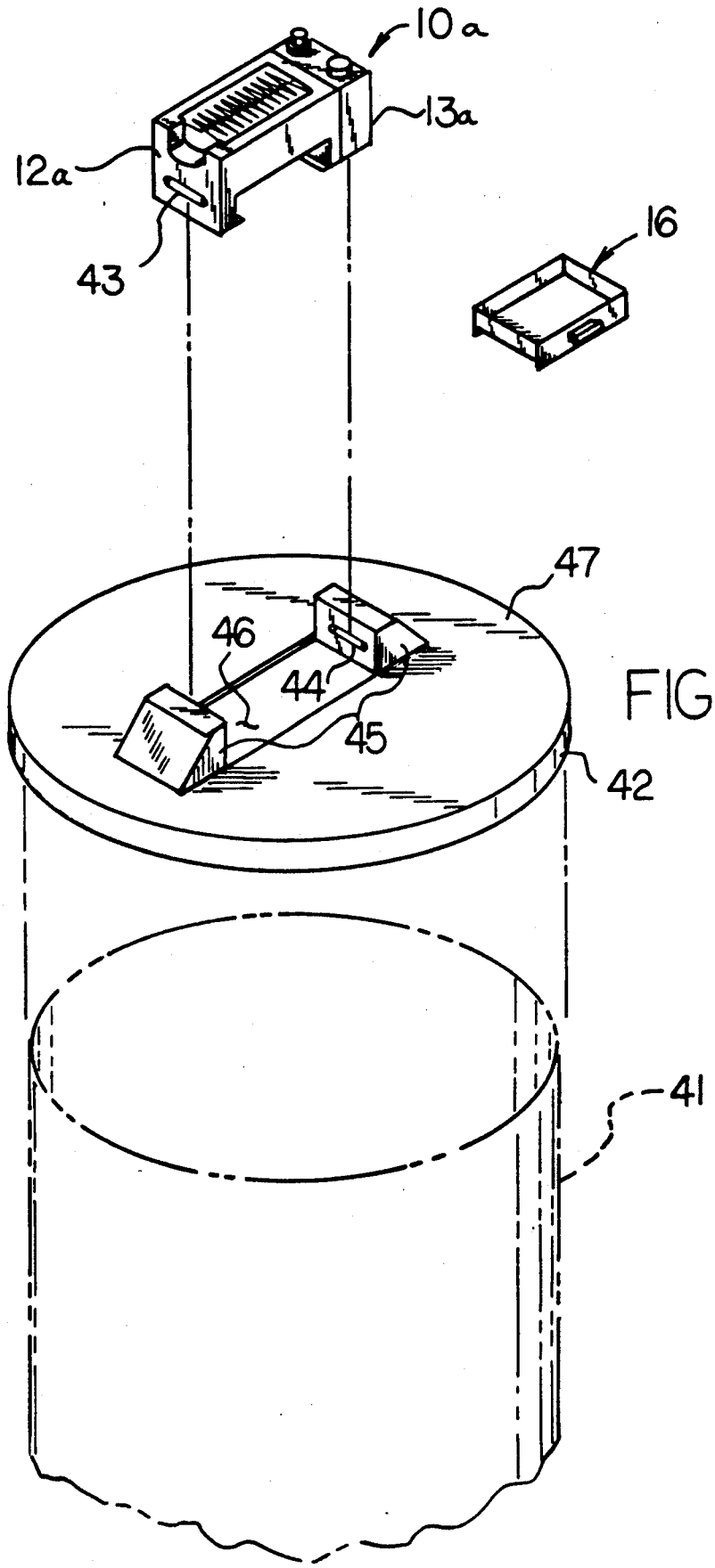
FIG. 9 is an isometric illustration of the invention arranged for mounting to an associated lid of a refuse disposal member.
Figure 10:
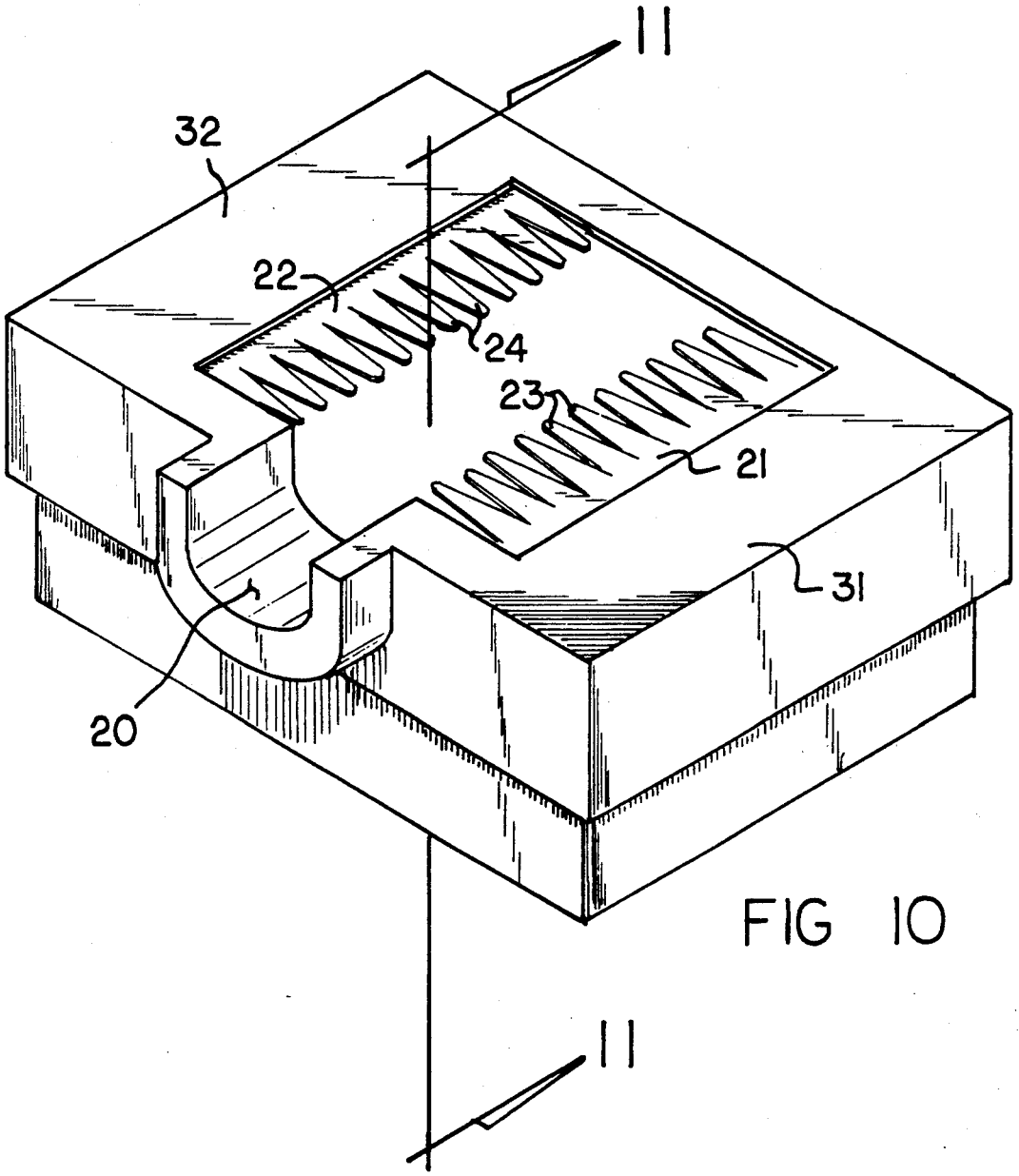
FIG. 10 is an isometric illustration of a modified cleaning structure utilized by the invention.

The apparatus further, as illustrated in FIG. 9, is arranged for mounting to an associated container 41 that includes a container lid 42 secured to an upper terminal end of the container 41. The container lid 42 includes a lid top wall 47 formed with a lid opening 46 therethrough. On opposed ends of the lid opening 46 are support plates 45 directed orthogonally and upwardly relative to the top wall of the lid, wherein the flange projections 44 projecting exteriorly of each of the support plates 45 for reception within respective rear and front end wall slots 43 mounted within the rear and front end walls 12*a* and 13*a*, as illustrated in FIG. 9, for securement of the housing 11 and the associated reservoir to the container lid 42, and more specifically to permit securement of the housing between the support plates for the direct deposit of hair within an underlying container for use in a commercial environment.

Figure 11:
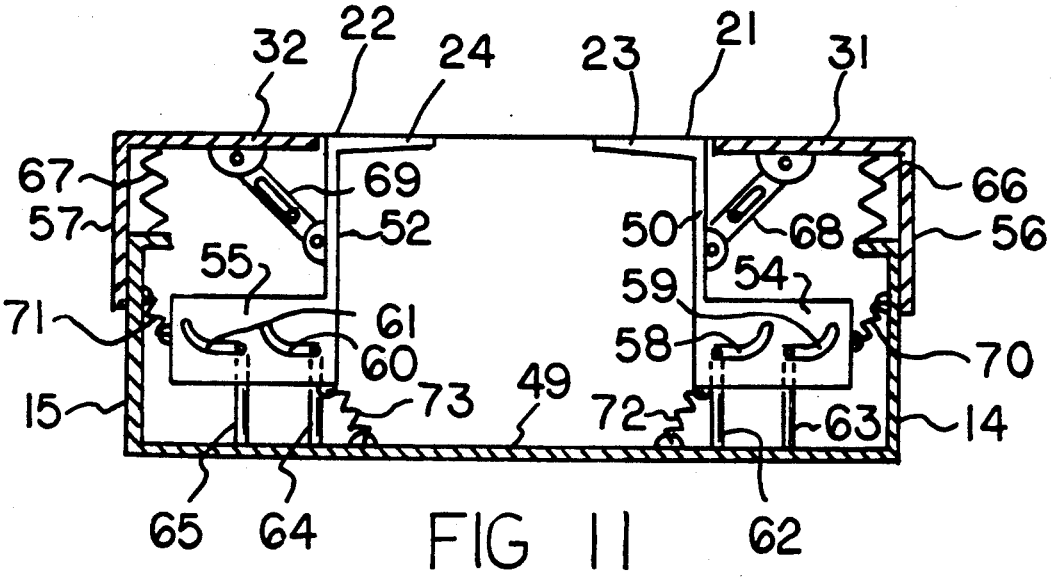
FIG. 11 is an orthographic view, taken along the lines 11—11 of FIG. 10 in the direction indicated by the arrows.
Figure 12:
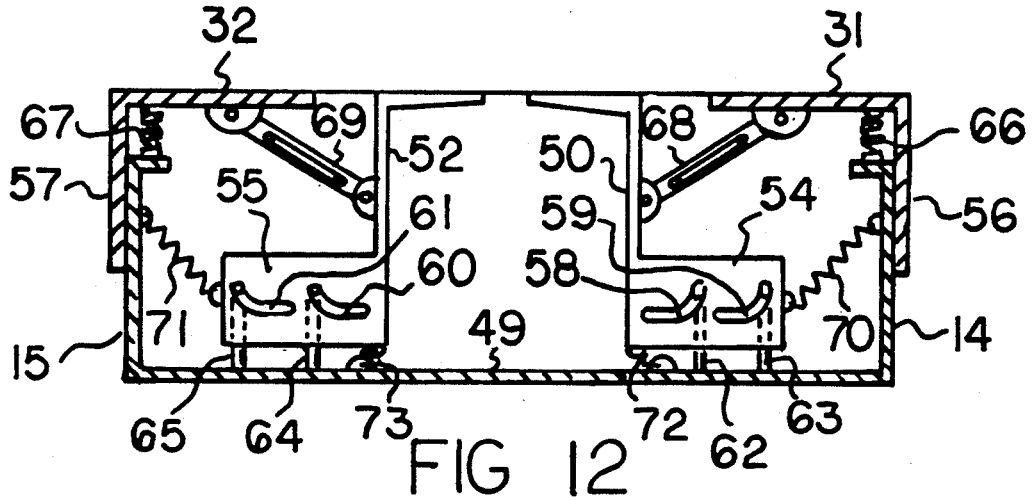
FIG. 12 is an orthographic cross-sectional illustration of the FIG. 10 in a second position.
Figure 13:
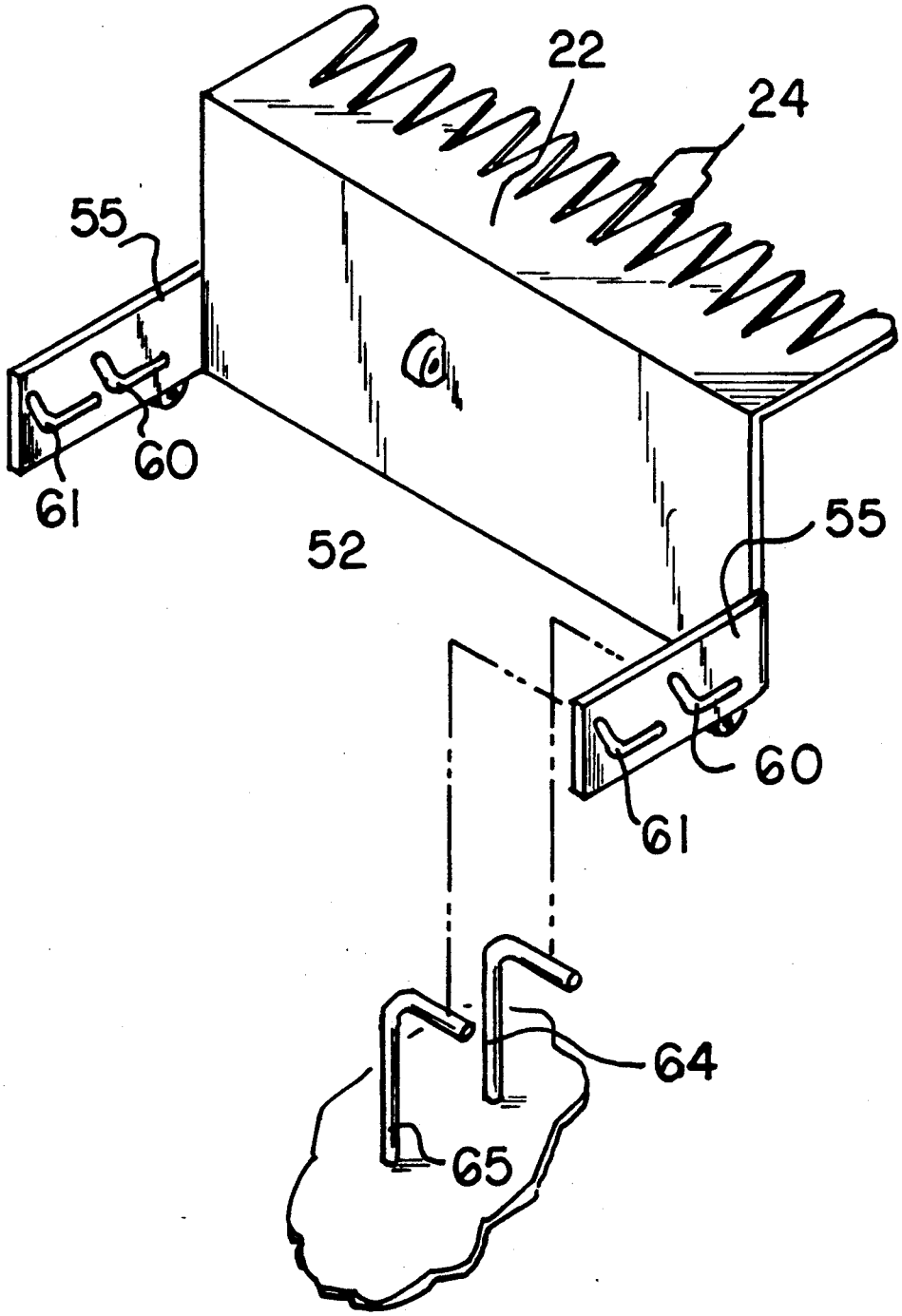
FIG. 13 is an isometric illustration of one of the support flanges in associated structure utilized by the invention, as set forth in the FIGS. 10–12.

With reference to FIGS. 11–13, the first and second teeth 23 and 24 are fixedly positioned to first and second plates 21 and 22. The housing top wall first and second flanges 31 and 32 are slidably mounted orthogonally relative to the housing side walls 14 and 15, with the use of top wall flange first and second skirts 56 and 57 orthogonally mounted to respective top wall first and second flanges 31 and 32. The first plate 21 and the second plate 22 include respective first and second support flanges 50 and 52 orthogonally mounted to a rear edge of the respective first and second flanges 50 and 52 respectively. The first and second support flanges extend orthogonally downwardly relative to the first and second plates, with the first support flange 50 including a plurality of spaced parallel first flange plates 54 orthogonally mounted to the first support flange to opposed sides thereof extending rearwardly of the first support flange 50. Second flange plates 55 mounted orthogonally and rearwardly of the second support flange 52 are arranged in a parallel coextensive relationship. The first and second flange plates 54 and 55 include guidance cam slots therewithin, wherein the first flange plates 54 include first flange plate first and second slots 58 and 59, with each pair of first flange plates first slots 58 arranged in a coextensive relationship, as well as the first flange plate second slots 59 arranged in a coextensive relationship relative to one another through the respective first flange plates 54. Similarly, the second flange plates 55 illustrated in more detail in FIG. 13 illustrates the use of the second flange plate first and second slots 60 and 61. First and second L-shaped guide rods 62 and 63 mounted to the housing floor 49 are received within the respective first flange plate first and second slots 58 and 59. Third and fourth L-shaped guide rods 64 and 65 are received within the respective second flange plate first and second slots 60 and 61. The cam slot configuration of the slots 58-61 and the respective guide rods 62-65 that are directed through the associated slots effect forward projection towards one another of the first and second teeth 23 and 24 from the first position, as illustrated in FIG. 11, to the second position, as illustrated in FIG. 12, when a brush member is positioned and forcibly directs the first and second plates 21 and 22 downwardly, wherein accordingly, the first and second teeth 23 and 24 project into the brush upon lifting of the brush subsequent to the projection of the teeth therewithin and effects a roll of hair and debris from within the brush structure. A top wall first spring 66 is positioned between the first side wall 14 and the top wall first flange 31, with a top wall second spring 67 mounted between an upper distal end of the housing second side wall and the top wall second flange 32 to bias the top wall first and second flanges 31 and 32 upwardly. First and second slide links 68 and 69 are mounted to the top wall first and second flanges 31 and 32, with the lower distal ends of the first and second slide links 68 and 69 mounted to the respective first and second support flanges 50 and 52 to effect guidance of the support flanges in a downward and forward projection towards one another within the housing. First support flange first springs 70 are mounted between the first flange plates 54 and an interior surface of the first side wall 14. Second support flange first springs 71 are mounted between the second flange plates 55 and the interior surface of the second side wall 15. First support flange second springs 72 are mounted between bottom surfaces of the first flange plates 54 and the housing floor 49, with second support flange second springs 73 mounted between lower edges of the second flange plates 55 and the housing floor 49 to normally bias the first and second plates 21 and 22 upwardly subsequent to their cleaning procedure. It should be noted that the organization of the FIGS. 7 and 8 are arranged for inclusion with the apparatus as illustrated in the FIGS. 11 and 12, but for purposes of clarity have been deleted from such illustration, where it is to be understood that the various conduit structure and nozzle members are contemplated for optional use within the structure set forth in the FIGS. 11 and 12.

FIG. 13 is an isometric illustration of the first and second plate members in cooperation with the associated supporting structure, for purposes of illustration.

Accordingly, it is believed the above set forth a complete disclosure as to the structure and functioning of the instant organization and no further discussion relative to the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair brush cleaning apparatus, comprising, a housing, the housing including a rear end wall spaced from a front end wall, and a first side wall spaced from a second side wall, and a top wall, and the rear end wall including a rear end wall recess directed through the rear end wall in communication with the top wall, and the top wall including a top wall opening in communication interiorly of the housing, and with the rear end wall recess, and a tray member directed through the housing orthogonally oriented and slidably mounted within the housing, and including a first tray wall and a second tray wall spaced from and parallel relative to one another, with the first tray wall and the second tray wall coplanar with the first side wall and the second side wall respectively when the tray member is mounted within the housing, and the housing including a bottom wall, and the tray member including a floor, the tray member floor coplanar with the housing bottom wall, and a first plate and a second plate mounted pivotally within the housing, wherein the first plate includes a first hinge, wherein the first hinge is mounted at an intersection of the first side wall and the top wall, and the second plate mounted to a second hinge, the second hinge mounted at an intersection of the second side wall and the top wall, and the first plate including first plate teeth, the second plate including second plate teeth, wherein the first plate teeth and the second plate teeth are inter-digitated in a first position when the first plate and the second plate are coplanar relative to one another, and wherein the first plate and second plate are displaced and defined at an oblique angle therebetween when a hair brush member is directed through the top wall opening displacing the first plate and the second plate.

2. An apparatus as set forth in claim 1 wherein the plate includes a first plate support flange, the first plate support flange mounted to the first pivot hinge below the top wall, and the second plate including a second plate support flange, the second plate support flange mounted to the second pivot hinge positioned below the top wall, wherein the first pivot hinge and the second pivot hinge are parallel relative to one another, and the first pivot hinge and the second pivot hinge are spring biased to bias the first plate and the second plate into the first position.

3. An apparatus as set forth in claim 2 including a reservoir mounted to the front end wall, the reservoir including a pump plunger and a fill cap, and a fluid contained within the reservoir, and a first flexible conduit directed through the first plate and into the first plate teeth, and a first nozzle mounted to the first conduit projecting upwardly relative to the first plate teeth, and the second conduit directed through the second plate and through the second plate teeth, with a plurality of second nozzles mounted to the second plate teeth projecting upwardly therefrom in fluid communication with the second conduit, whereupon displacement of the pump plunger effects projection of the fluid through the first nozzle and the second nozzles.

4. An apparatus as set forth in claim 3 further including a container, the container including a container lid, the container lid including a lid opening, and the lid opening including spaced support plates, the spaced support plates spaced apart a predetermined distance, and the rear end wall and the front end wall spaced apart a predetermined length, wherein the predetermined length is substantially equal to the predetermined distance, and the front end wall and the rear end wall each include a slot, and the support plates each include a flange projection receivable within the slots to position the housing over the lid opening when the tray member is removed relative to the housing.

5. A hair brush cleaning apparatus, comprising, a housing, the housing including a rear end wall spaced from a front end wall, and a first side wall spaced from a second side wall, and a top wall, and the rear end wall including a rear end wall recess directed through the rear end wall in communication with the top wall, and the top wall including a top wall opening in communication interiorly of the housing, and with the rear end wall recess, and a tray member directed through the housing orthogonally oriented and slidably mounted within the housing, and including a first tray wall and a second tray wall spaced from and parallel relative to one another, with the first tray wall and the second tray wall coplanar with the first side wall and the second side wall respectively when the tray member is mounted within the housing, and the housing including a bottom wall, and the tray member including a floor, the tray member floor coplanar with the housing bottom wall, and the top wall including a top wall first flange spaced from the first side of the top wall opening, and a top wall second flange spaced upon a second side of the top wall opening, the top wall first flange including a first skirt extending orthogonally downwardly relative to the top wall first flange positioned exteriorly of and in sliding relationship relative to the housing first side wall, the top wall second flange including a second skirt orthogonally mounted to the top wall second flange slidably positioned exteriorly of the housing second side wall, and a first plate positioned within the top wall opening adjacent the top wall first flange, and a second plate positioned within the top wall opening adjacent the top wall second flange, the first plate including a first support flange orthogonally mounted downwardly relative to the first plate within the housing, and a second support flange fixedly mounted to the second plate extending downwardly within the housing, wherein the first support flange and the second support flange are arranged in a parallel relationship relative to one another, and the first plate including first teeth members, the second plate including second teeth members, wherein the first teeth members and the second teeth members are arranged in confronting relationship relative to one another in a coplanar relationship, and spring means arranged for biasing the first plate and the second plate in a spaced relationship relative to the housing bottom wall.

6. An apparatus as set forth in claim 5 wherein a top wall first spring is mounted between the top wall first flange at an upper distal end of the housing first side wall, and a top wall second spring is mounted between the top wall second flange and an upper distal end of the housing second side wall, and a first slide link is mounted between the top wall first flange and the first support flange, and a second slide link is mounted between the top wall second flange and the second support flange to orient the first flange and the second flange in displacement within the housing.

7. An apparatus as set forth in claim 6 wherein the first support flange includes at least one first flange plate fixedly and orthogonally mounted to the first support flange extending rearwardly thereof, and the second support flange includes at least one second flange plate fixedly and orthogonally mounted to a rear surface of the second support flange, the first flange plate including a first flange plate first arcuate slot and a first flange plate second arcuate slot, the second flange plate including a second flange plate first arcuate slot and a second flange plate second arcuate slot, and each of said slots includes an L-shaped guide rod directed therethrough, a lower distal end of each guide rod is orthogonally and fixedly mounted to the housing bottom wall within the housing, and the spring means includes a first support flange first spring mounted between the housing first side wall and the first flange plate, and a second support flange first spring mounted between the second flange plate and the housing second side wall, and a first support flange second spring mounted between the first support flange and the housing bottom wall, and a second support flange second spring mounted between the second support flange and the housing bottom wall.

* * * * *